United States Patent [19]

Whitford

[11] Patent Number: 4,887,554

[45] Date of Patent: Dec. 19, 1989

[54] ANIMAL DRENCH

[76] Inventor: Darryl R. Whitford, Rosedale, South Australia, 5350, Australia

[21] Appl. No.: 197,460

[22] Filed: May 23, 1988

[30] Foreign Application Priority Data

May 27, 1987 [AU] Australia ..... PI2201

[51] Int. Cl.[4] ..... A61D 7/00

[52] U.S. Cl. ..... 119/159

[58] Field of Search ..... 119/159; 604/31, 66, 604/67; 239/99

[56] References Cited

U.S. PATENT DOCUMENTS 3,699,928 10/1972 Cowan ..... 119/159

3,870,023 3/1975 Wilson ..... 119/159

4,589,372 5/1986 Smith ..... 119/51 R

FOREIGN PATENT DOCUMENTS 58027 1/1975 Australia ..... 119/159

*Primary Examiner*—Robert P. Swiatek

*Attorney, Agent, or Firm*—Rodman & Rodman

[57] ABSTRACT

There is provided a transducer arranged to identify the body weight of each animal, the transducer providing a voltage signal which is amplified to drive a motor of an electrically operated pump which pumps drenching chemical to a handpiece, the handpiece having a discharge tube which is inserted in an animal's mouth.

6 Claims, 2 Drawing Sheets

Fig.1a.

Fig.1b.

ANIMAL DRENCH

This invention relates to a device which is useful for the "drenching" of an animal, that is, assisting an operator to apply the correct quantity of medication to an animal by injecting it into the animal's mouth.

BACKGROUND OF THE INVENTION

It is often required to provide an oral drench to livestock to control internal parasites and other maladies. Sheep are usually drenched twice per year, and goats about four times per year.

It is necessary that the drench chemical should be administered in a volume which varies according to the weight of the animal, and in most instances is approximately proportional to that weight. Because the hand-operated drenchers which are presently used require to be preset for any one volume, it becomes necessary to muster and separate the flock into size groups (sheep, lambs, etc.) before drenching.

In some instances however an operator will rely upon his judgement and not separate the flock, but give a reduced amount from the drenching gun to a smaller animal by not fully operating a control lever on the handpiece (sometimes called a "gun"). This often results in an inappropriate dose, and either an ineffective drench or, if excessive drench chemical is applied, the possibility of damaging or even killing the animal.

In flocks of angora goats for example, the size variation is very evident for various age groups, and there is a large variation in weight between young kids and adult goats.

Hand-operated drench guns as presently used cause hand fatigue, as a strong return spring is required in order to pump the thick solution of drench chemical into the gun before the gun trigger is operated, and this spring pressure must be overcome by hand.

The main object of this invention is to provide means whereby a flock of mixed animals can be appropriately drenched without first separating the animals into weight/size groups, and to be able to administer the correct amount of drench chemical per animal. This will not only be effective in controlling parasites, but also avoid overdrench and possible damage to the animal.

It is a second object of the invention to provide improvements whereby operator fatigue can be reduced, and to provide a means whereby little effort only is required to operate a pump mechanism of a drenching gun or other handpiece.

It is a still further object of the invention to provide means whereby an animal's weight and drench dosage is recorded so as to assist in effective livestock management.

BRIEF SUMMARY OF THE INVENTION

In this invention, there is provided a transducer arranged to identify the body weight of each animal, the transducer providing a voltage signal which is amplified to drive a motor of an electrically operated pump which pumps drenching chemical to a handpiece, the handpiece having a discharge tube which is inserted in an animal's mouth.

There is also provided a regulating circuit which limits the dosage of drenching chemical administered by the pump, by stopping the pump motor when a dosage is administered which is a proportion of the animal's weight.

More specifically, in this invention an animal drench device consists of animal support means, a weight responsive transducer at least partly supporting the weight of an animal, a drenching handpiece having a discharge tube, a drench dosage pump, a hose between the drenching handpiece and the dosage pump, an electric motor coupled to the dosage pump and operable to actuate the pump to force a dosage of drenching chemical to and through the discharge tube of the drenching handpiece, a switch on the drenching handpiece, and an electrical circuit interconnecting the transducer, switch and motor, the electrical circuit comprising amplifier means which amplify a transducer signal responsive to increase of weight imposed on the transducer, said amplified signal driving the motor, the electric circuit also comprising regulating means which control said motor drive to limit said dosage in response to said weight increase.

In one embodiment of the invention, coupling means couple the weighing means and the drenching means into an electronic memory for information retrieval by a computer system.

The motor can be a rotary electric motor, and the dosage pump a piston pump coupled to the motor shaft by a screw-and-nut assembly, but in another embodiment the motor can be a stepping motor, the number of revolutions being proportional to animal weight. Alternatively, the transducer signal can control time of motor operation.

BRIEF DESCRIPTION OF THE DRAWINGS

An embodiment of the invention is described hereunder in some detail with reference to and is illustrated in the accompanying drawings in which.

DETAILED DESCRIPTION OF THE PREFERRED EMBODIMENT

Figures 1, 1A, 1B:
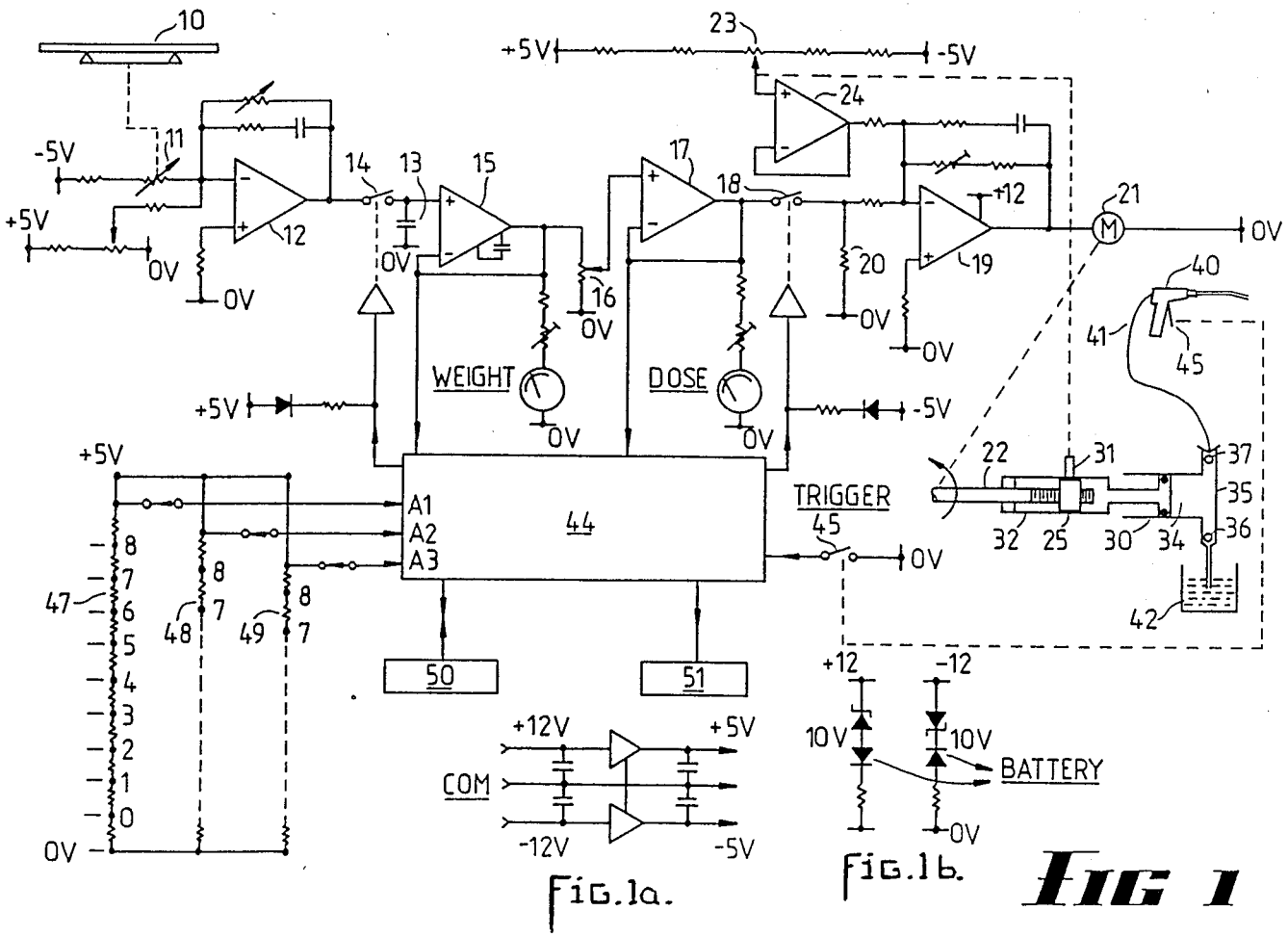
FIG. 1 is an electronic circuit showing the control means whereby a drenching dosage is delivered to a drench handpiece in proportion to the weight of an animal.
FIG. 1*a* is a power supply for supplying −5 V, 0 V, and +5 V to correspondingly marked elements of the circuit of FIG. 1.
FIG. 1*b* is a power supply for supplying −12 V, 0 V, and +12 V to correspondingly marked elements of the circuit of FIG. 1.

Referring first to FIG. 1, an animal to be drenched is placed on a weighing platform 10 which is at least partly supported by a transducer 11, the transducer 11 providing an electrical output which is dependent upon, and in this embodiment proportional to, the increase in apparent weight of the platform 10. Amplifier 12 amplifies the transducer output and produces a signal voltage between 0 and +5 volts over the desired weight range. Power supply 52 (FIG. 1*a*) supplies −5 V, 0 V, and +5 V to the correspondingly marked elements of the circuit of FIG. 1. Similarly power supply 53 (FIG. 1*b*) supplies −12 V, 0 V, and +12 V to the correspondingly marked elements of the circuit of FIG. 1.

The amplified signal voltage is transferred to capacitor 13 via switch 14, this being a normally closed switch. The voltage on capacitor 13 will therefore smooth the fluctuating weight transducer output and follow the voltage signal proportional to the weight as detected by the transducer 11. The capacitor 13 is of the low internal leakage type.

Amplifier 15 is a voltage follower, producing a high impedance to the voltage across capacitor 13, and therefore reproducing the signal voltage, and its output goes into a variable control potentiometer 16, as well as driving the calibrated weight meter. The output of potentiometer 16 is a proportion of the signal voltage, enabling a scaling of the control voltage as a proportion of the weight range. The potentiometer 16 setting therefore sets the dose rate (0.0 to 0.2 ml/Kg). Amplifier 17 produces a high impedance to potentiometer 16, buffers the output of potentiometer 16, and drives the dose rate meter (which may have a low impedance). The two meters provide an immediate visual check.

The output voltage of amplifier 17 is proportional to the weight and is fed to a normally open switch 18 which is an interconnecting switch. When closed, switch 18 will transfer the control voltage to servo-amplifier 19, which is configured as a conventional input-summing amplifier, that is, the output voltage will swing in such a polarity and amplitude as to cause a return current to flow back into its input so as to cancel any current caused by an input voltage impressed across the input resistor 20. In this configuration the return current is limited, and the amplifier output voltage swing is unable to impress enough current to cancel out the input current, causing the output voltage swing to reach its maximum possible value.

This output voltage will cause the motor 21 (a DC servo motor) to rotate in one direction. Without further control, the motor 21 would keep running, however its shaft is coupled to a screw thread 22 in turn coupled to a linear potentiometer 23.

The rotation of motor 21 will therefore cause the output voltage of potentiometer 23 to rise, as it is moved by the screw thread 22.

The voltage of the linear potentiometer 23 is transferred by the buffer amplifier 24 through a resistor to the input of servo-amplifier 19, in such a polarity as to cause a cancellation of the input voltage across the input resistor 20.

As the movement of the motor, in driving the linear potentiometer 23, causes the output voltage of the servo-amplifier 19 to decrease, the motor slows, until a point of stabilisation is reached at which the output voltage of servo-amplifier 19 is insufficient to rotate the motor.

The motor 21 will then have moved the mechanical screw thread nut 25, and thereby the wiper of linear potentiometer 23, by such a distance as to cause the output voltage to be sufficient to cancel the input voltage across the resistor 20.

The voltage across resistor 20 will therefore control the travel position of the nut 25 on the screw thread 22.

When the voltage across input resistor 20 is returned to zero, the voltage from the linear potentiometer 23 will have correspondingly increased and will cause the servo-amplifier 19 to reverse its output voltage, causing the motor to return the potentiometer 23 to its original position where it has an output of zero volts.

The output of servo-amplifier 19, in moving the motor and the feedback potentiometer 23 in response to an input signal, is a conventional servo-control mode.

When an animal is placed on the weighing platform 10, it will at times cause an erratic reading of the weight due to its movement. Switch 14 is opened at such a time that the animal is reasonably still and thereby the voltage across the capacitor 13 is held at its then value, irrespective of further movement of the animal on the platform. This voltage will be held quite constant since a capacitor 13 has low leakage, and amplifier 15 has a high input resistance.

A proportion of the weight signal is set by the control potentiometer 16 in order to control the required dose rate, since the amplitude of the control voltage will result in controlling the distance the motor moves the threaded nut 25, and thereby the resultant amount of drench which is administered.

Normally open switch 18 is then closed for a set period (in this embodiment one second) during which time the motor will move to a corresponding position set by control voltage.

At the end of this time period, when the switch 18 opens, the motor will return to its zero position.

Therefore the weight of the animal on the platform will cause the motor to move the screw thread nut 25 by a distance which is proportional to the animal's weight, the proportion being set by the control potentiometer 16.

Figure 2:
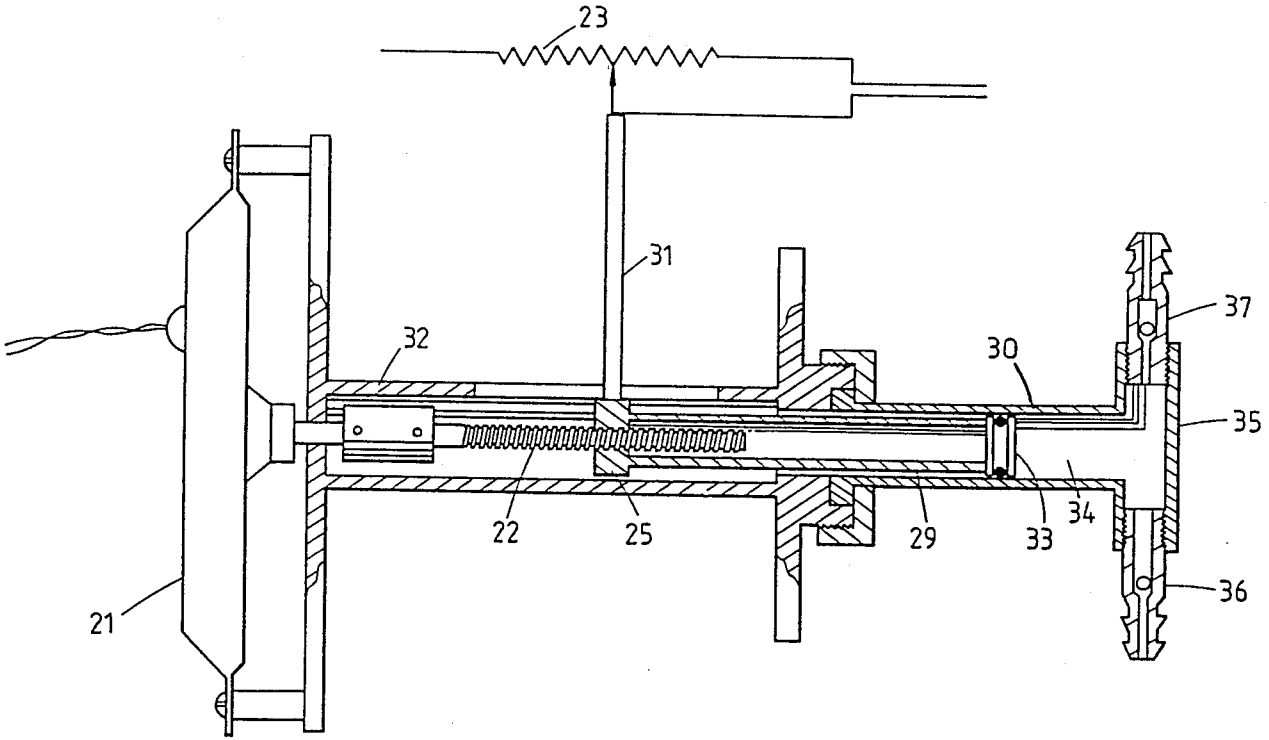
FIG. 2 is a diagrammatic cross-sectional view illustrating the manner in which a pump is actuated by a rotary motor in response to and under the control of an electronic signal from the circuit of FIG. 1.

Reference is now made to the mechanical pump which is diagrammatically illustrated in FIG. 2.

In order to facilitate the movement and cause the correct amount of drench to be injected orally into the animal, the threaded nut 25 is coupled to piston rod 29 of a piston pump 30 as shown in FIG. 2.

The DC servo motor 21 has its shaft 22 threadably engaged by the nut 25 as described above. Rotation of the shaft therefore causes the nut 25 to move in a linear movement. The finger 31, extending through a slot in a support sleeve 32, prevents the nut from rotating. The finger 31 also drives the wiper of feedback potentiometer 23 as described above. The piston rod 29 is coupled to nut 25 which axially moves the piston 33 inside a cylinder 34. The cylinder 34 is directly in fluid flow communication with the pump head 35, the head 35 comprising an inlet non-return valve 36 and an outlet non-return valve 37.

The control voltage developed by transducer 11 due to the weight of an animal will cause the motor 21 to rotate in such a direction as to drive the piston into the cylinder, lift the valve 37, and drive the drench chemical into the handpiece 40, through hose 41. A return to zero control voltage will cause the piston 33 to retract, producing a vacuum and drawing more drench through valve 36 into the pump head 35, from the reservoir 42.

For the purposes of livestock control, the circuit of FIG. 1 embodies logic and data storage facilities. A small microprocessor 44 of known type is used to facilitate the timing control of the switches 14 and 18, when required by the switch 45 located on the drench handpiece handle in a sequence previously decribed.

In addition, the microprocessor is used to store information relative to the drenching operation for future recall and analysis by a livestock management programme. The computer records the weight output of the amplifier 15 and the dose setting of the amplifier 17, by using an analogue to digital converter, in response to the trigger switch 45 being activated.

In addition, three ten-position switches 47, 48 and 49 selectively produce one of ten voltages to three respective analogue inputs of the computer 44, allowing a "3 digit" number to be read by the computer.

When the drench handpiece trigger switch 45 is closed, the computer 44 will record the weight, the relative dose setting and the code number set up by the three switches 47, 48 and 49. This information is then transferred to a portable memory unit 51 to facilitate later recall. At the same time, the computer 44 causes closure of switch 18 to activate the servo-amplifier 19 as described above.

A remote key pad 50 can be used also to enter other numerical data relative to each animal, the computer correlating all the data, referring it to that animal.

Other automatic numeral entry can also be used, for example "bar code" words etc. to automatically read an animal's ear tag number.

It is clearly an equivalent of the above device to substitute a pneumatic cylinder for the electric DC servo motor, controlled however in a similar manner, or for the switch 45 to be a pneumatic switch which remotely controls an electrical slave switch.

The device herein has been described as an "animal drench", since this application is its primary use. However, it will be clear to those skilled in the art, that by merely changing the setting of the dosage (potentiometer 16), and having an appropriate head on the handpiece (for example the discharge tube being a hypodermic syringe), the device can be used for ruminant injection through the stomach wall of cattle, for innoculation, and for external applications for control of lice.

I claim:

1. An animal drenching device, comprising:

animal support means, a weight responsive transducer at least partly supporting the weight of an animal, a drenching handpiece having a discharge tube, a drench dosage pump comprising a piston/cylinder assembly wherein said piston slidably and sealably engages said cylinder, a piston rod carried by the piston, a nut on the piston rod, a screw thread threadably engaging the nut, a hose between the drenching handpiece and the dosage pump, an electric motor having a rotary shaft coupled to said screw thread to move the piston axially within the cylinder upon motor operation to force a dosage of drenching chemical to and through the discharge tube of the drenching handpiece, a switch on the drenching handpiece, an electrical circuit interconnecting the transducer, switch and motor, the electrical circuit comprising amplifier means which amplify a transducer signal responsive to increase of weight imposed on the transducer, said amplified signal driving the motor, the electric circuit also comprising regulating means which control said motor drive to limit said dosage in response to said weight increase.

2. An animal drench device according to claim 1 further comprising a pump head at the end of the cylinder, an inlet valve in fluid flow communication with the pump head, an outlet valve also in fluid flow communication with the pump head, and a reservoir, each said valve being a one-way valve and so arranged that, upon movement inwardly of the piston in the cylinder, the piston effects said forcing of the drenching chemical, and upon movement outwardly of the piston, said dosage chemical is drawn from the reservoir into the cylinder.

3. An animal drench device according to claim 1 wherein said regulating means comprise a servo-amplifier activated by closure of said handpiece switch, output of the servo-amplifier driving the motor, and feedback means coupled to the motor responsive to motor drive to vary control voltage of the servo-amplifier to thereby control motor operation in a servo-control mode.

4. An animal drench device according to claim 1 wherein said amplifier means comprise a plurality of interconnected amplifiers which provide an output voltage proportional to the weight supported by the transducer, a servo-amplifier, an interconnecting switch itself closed by closure of said handpiece switch to apply said output voltage to the servo-amplifier as a control voltage, a linear potentiometer mechanically coupled to said nut and arranged to provide a variable voltage, and a buffer amplifier applying that voltage to said control voltage but in an opposite polarity whereby said servo-amplifier controls the motor in a servo-control mode.

5. An animal drench device according to claim 1 wherein said amplifier means comprise a first amplifier which amplifies said transducer signal, a second amplifier which reproduces the voltage output of the first amplifier, a potentiometer which divides the output of the second amplifier to provide a control voltage proportional to amplitude of the transducer signal, a third amplifier which amplifies that control voltage to provide a further control voltage, and said regulating means comprises a servo-amplifier which controls said motor in a servo-control mode, a potentiometer mechanically coupled to the motor to provide a variable voltage which varies as a function of motor operation, the difference between the further control voltage and that variable voltage being applied to the servo-amplifier, the servo-amplifier being in an input-summing configuration such that, upon said further control voltage being reduced to zero, output of the servo-amplifier reverses, in turn reversing motor rotation.

6. An animal drench device according to claim 1 further comprising a microprocessor so coupled to said electrical circuit as to control switching in that circuit, and to store information relating to drenching and livestock weight.

* * * * *